US005800113A

United States Patent [19]

Yuyama et al.

[11] Patent Number: 5,800,113

[45] Date of Patent: Sep. 1, 1998

[54] DEVICE FOR SEPARATING SERIES-CONNECTED PLASTIC AMPULES

[75] Inventors: Shoji Yuyama; Hiroyasu Hamada, both of Toyonaka, Japan

[73] Assignee: Kabushiki Kaisha Yuyama Seisakusho, Osaka, Japan

[21] Appl. No.: 826,336

[22] Filed: Mar. 27, 1997

[51] Int. Cl.[6] ..... B65G 65/00

[52] U.S. Cl. ..... 414/416; 83/487; 225/102; 414/412; 414/798.1

[58] Field of Search ..... 414/411, 412, 414/414, 416, 797.5, 798, 798.1; 83/487, 488, 161; 225/93, 102, 103

[56] References Cited

U.S. PATENT DOCUMENTS

| | | | |
|---|---|---|---|
| 1,158,045 | 10/1915 | Graham | 414/798.1 |
| 3,733,951 | 5/1973 | Fujimoto | 83/487 X |
| 3,902,615 | 9/1975 | Levy et al. | 414/416 X |
| 3,997,067 | 12/1976 | Murata | 414/798.1 |
| 4,044,896 | 8/1977 | Reinecke | 414/798.1 X |
| 4,865,515 | 9/1989 | Dorner et al. | 414/797.5 |
| 4,897,019 | 1/1990 | Lemaire et al. | 414/798.1 X |
| 4,909,412 | 3/1990 | Cerf | 414/798.1 X |
| 4,946,339 | 8/1990 | Berg et al. | 414/412 X |
| 5,449,265 | 9/1995 | Legrady et al. | 414/412 |
| 5,628,353 | 5/1997 | Rather | 225/93 X |

*Primary Examiner*—David A. Bucci

*Attorney, Agent, or Firm*—Wenderoth, Lind & Ponack, L.L.P.

[57] ABSTRACT

An ampule dispenser having a carrier for transporting plastic ampules arranged side by side and series-connected together in a strip in a longitudinal direction, a guide plate provided over a delivery end of the carrier for holding down the strip of series-connected plastic ampules, receiver for receiving the plastic ampule at the head of the strip fed from the delivery end of the carrier, and an ampule separator for separating the ampule at the head of the strip along a separating line provided between adjacent ones of the ampules.

7 Claims, 7 Drawing Sheets

DEVICE FOR SEPARATING SERIES-CONNECTED PLASTIC AMPULES

BACKGROUND OF THE INVENTION

This invention relates to a device for separating series-connected plastic ampules from one another.

Ampule dispensers capable of dispensing a required number of ampules one by one are disclosed in unexamined Japanese utility model publication 5-86873 and examined Japanese utility model publication 6-14753.

Some of these ampule dispensers dispense glass ampules while others do plastic ampules.

Referring to FIGS. 10 and 11, a plastic ampule comprises a body a filled with liquid medicine and a tab d having a cap c and integrally connected with the body through a separation line b. The tab d is separable from the body a by twisting it. By separating the tab d, the top of the body is opened.

A plurality of such plastic ampules A1 are arranged side by side and series-connected in a strip. Cut-apart lines B or thin portions are defined between the adjacent plastic ampules A1.

In order to dispense series-connected plastic ampules A0 from an ampule dispenser, plastic ampules A1 have to be separated from one another along the lines B.

Heretofore, ampules were separated manually, so that such separation of ampules were very troublesome.

An object of this invention is to provide an ampule dispenser which can separate series-connected ampules with high efficiency.

SUMMARY OF THE INVENTION

According to this invention, there is provided an ampule dispenser comprising a carrier means for transporting plastic ampules arranged side by side and series-connected together in a strip in a longitudinal direction, a guide plate provided over a delivery end of the carrier means for holding down the strip of series-connected plastic ampules, receiver means for receiving the plastic ampule at the head of the strip fed from the delivery end of the carrier means, and an ampule separating means for separating the ampule at the head of the strip along a separating line provided between adjacent ones of the ampules.

The separating means may comprise a cutter adapted to be moved along the separating line, or comprise a recess formed in the stopper member and capable of receiving one plastic ampule, and a rotating means for rotating the stopper member about an axis parallel to the direction in which the strip of series-connected ampules are fed.

In order to supply strips of series-connected plastic ampules one by one, the ampule dispenser may be further provided with an ampule storage means provided over the carrier means and capable of storing a plurality of strips of series-connected plastic ampules in a stack, and a discharge means for dropping the lowermost one of the strips of series-connected plastic ampules stored in the ampule storage means onto the carrier means.

Every time the ampule at the head of a strip of series-connected plastic ampules being fed by the carrier means is received in the stopper member, the ampule at the head of the strip is separated by the separating means.

Other features and objects of the present invention will become apparent from the following description made with reference to the accompanying drawings, in which:

DETAILED DESCRIPTION OF THE PREFERRED EMBODIMENT

The embodiment of this invention is now described with reference to FIGS. 1–9.

Figure 1:
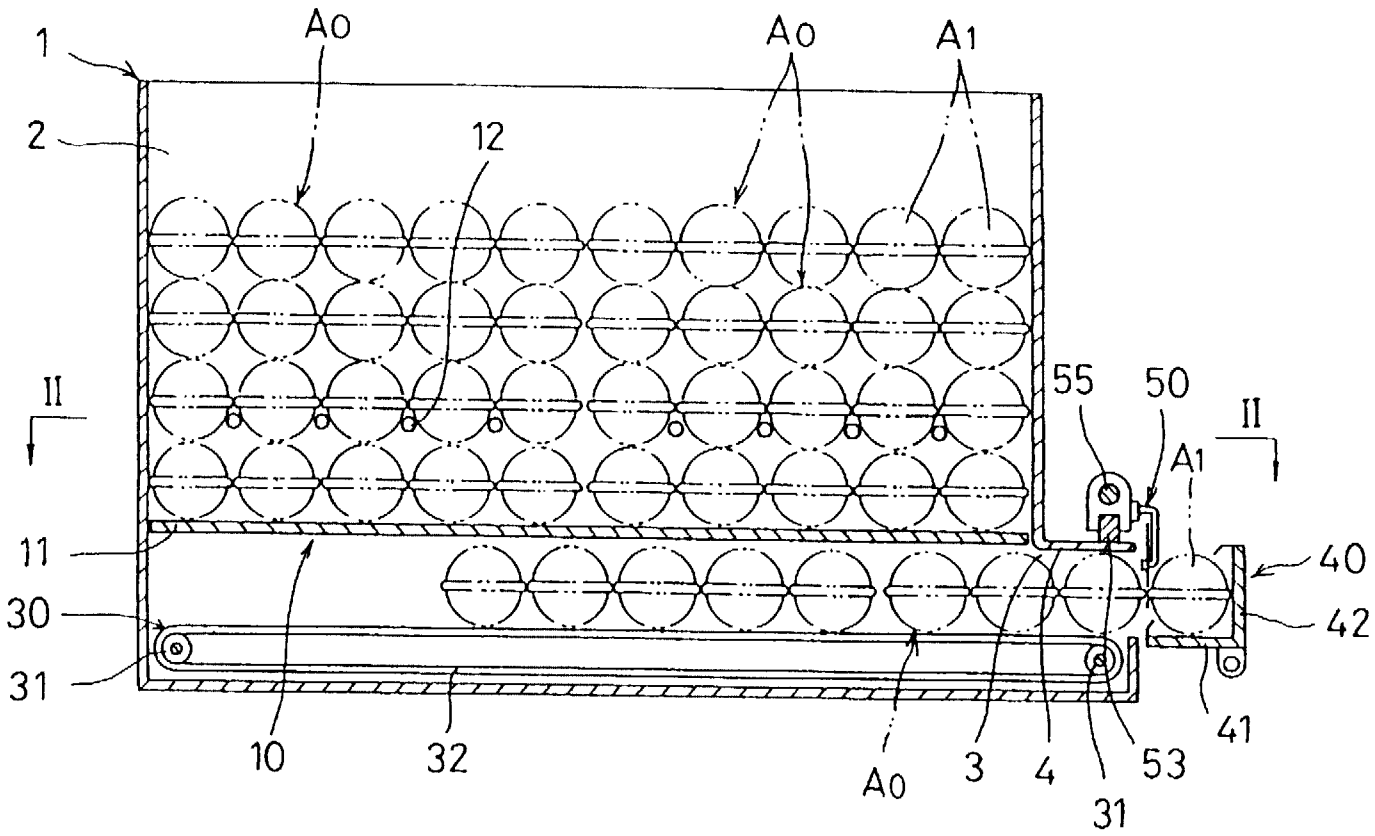
FIG. 1 is a vertical sectional front view of one embodiment of the separating device according to this invention.

Referring first to FIG. 1, a plurality of strips of series-connected plastic ampules A0 are stacked in an ampule storage case 2 of a stocker 1.

The strips of ampules A0 in the case 2 are taken out one by one from the bottom of the case by an ampule ejector 10.

Figure 2:
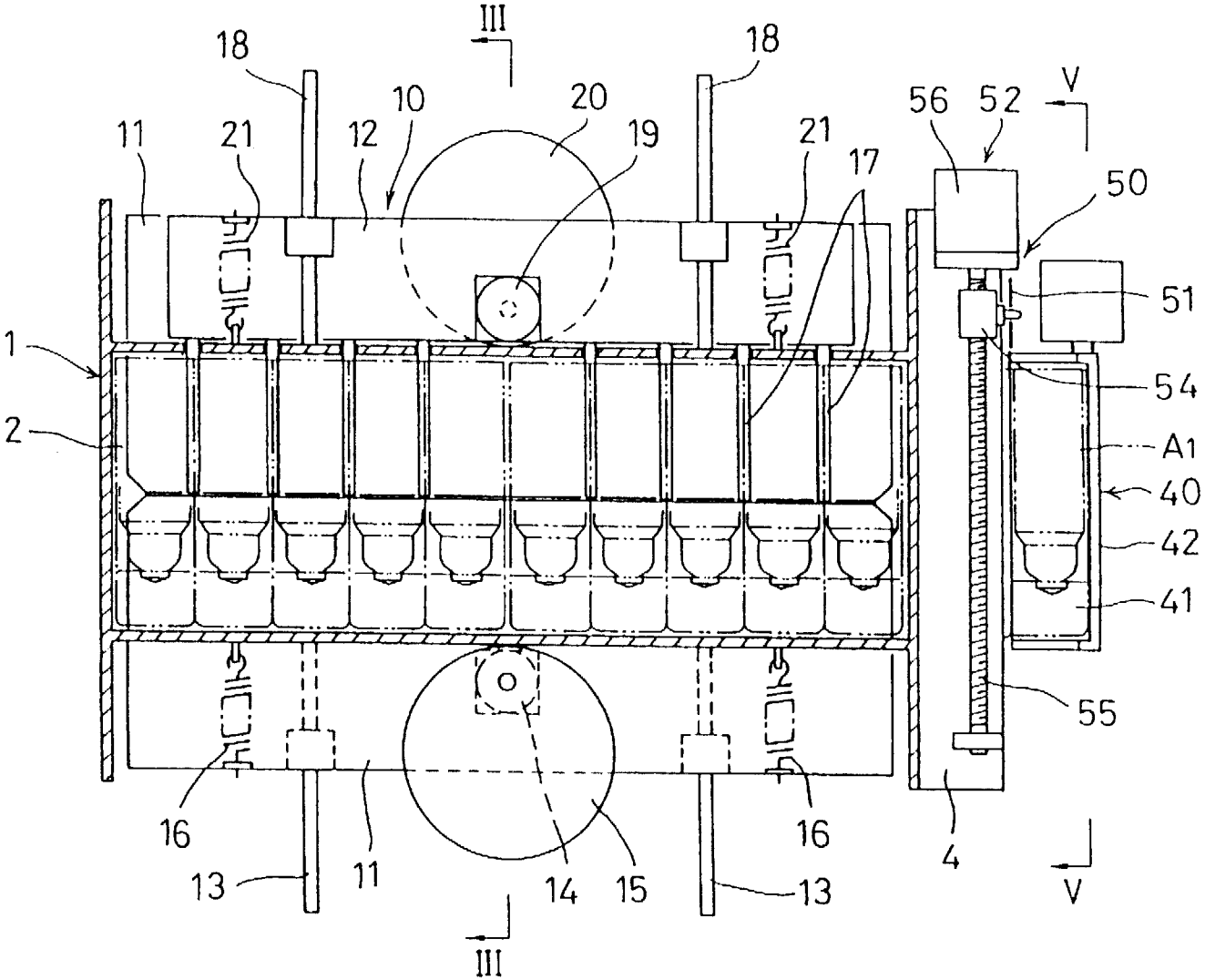
FIG. 2 is a sectional view taken along line II—II of FIG. 1.
Figure 3:
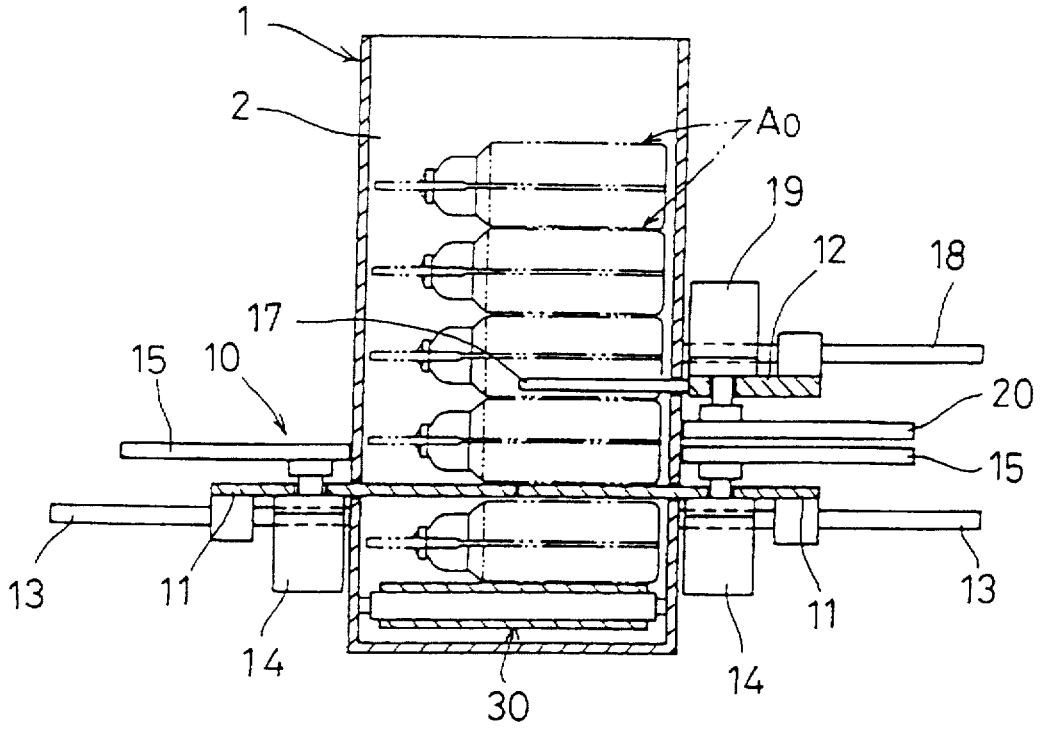
FIG. 3 is a sectional view taken along line III—III of FIG. 2.

Referring to FIGS. 2 and 3, the ampule ejector 10 includes a first stopper 11 for supporting the lowermost strip of series-connected plastic ampules A0 and a second stopper 12 for supporting the second lowest strip of plastic ampules A0.

Figure 4:
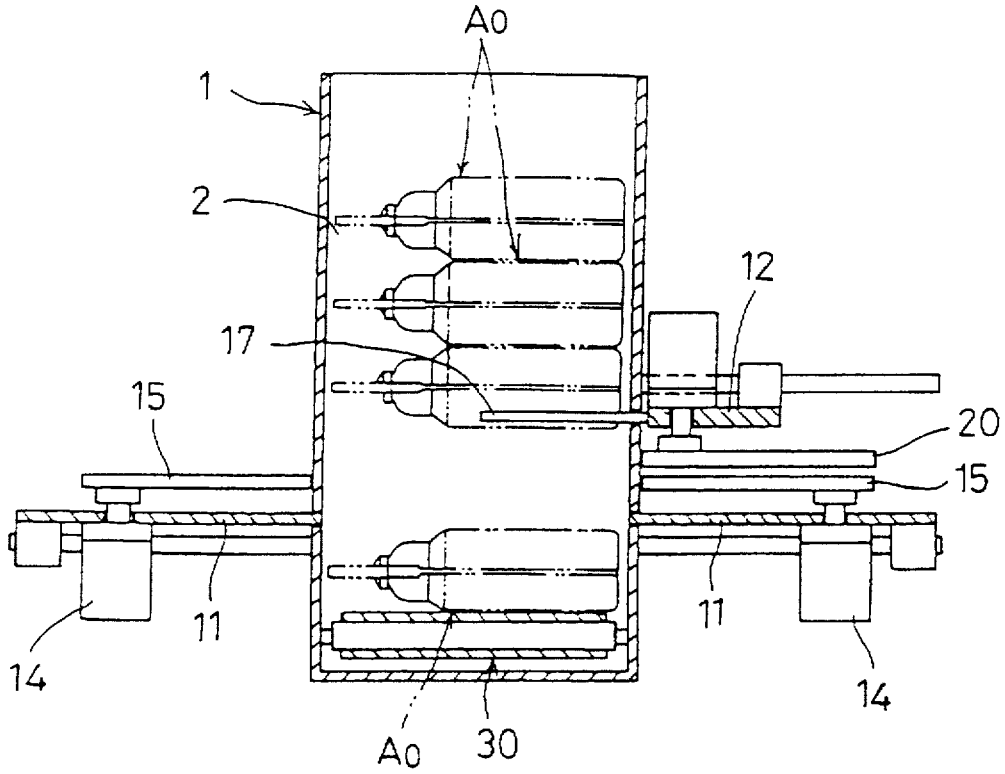
FIG. 4 is a sectional view of FIG. 3 in an operational state.

As shown in FIGS. 3 and 4, the first stopper 11 comprises two plate members slidably supported on guide shafts 13 extending from the sides of the stocker 1. Each plate member of the stopper 11 carries a motor 14 having a cam 15 mounted on its rotary shaft. Springs 16 bias the plate members of the first stopper 11 toward each other, keeping the cams 15 in contact with the side walls of the stocker 1. Thus, by driving the motors 14, the cams 15 rotate, moving the plate members of the first stopper 11 into and out of the case 2. When moved into the case 2 (FIG. 3), the stopper 11 supports the lowermost strip of ampules A0.

The second stopper 12 is slidably mounted on guide shafts 18 extending from one side of the stocker 1 and has a comb member 17 at its end which is adapted to be inserted into the case 2 to support the second lowest strip of ampules A0.

The second stopper 12 carries a motor 19 having a cam 20 mounted on its rotary shaft. Springs 21 bias the second stopper 12 in such a direction as to keep the cam 20 in contact with the side wall of the stocker 1. Thus, by driving the motor 19, the cam 20 rotates, moving the second stopper 12 into and out of the case 2. When moved into the case 2 (FIG. 3), the stopper 12 supports the second lowest strip of ampules A0.

The first stopper 11 and the second stopper 12 are controlled so that one of them is moved out of the case when the other is moved into the case and stopped. Thus, every time the first stopper 11 is moved out of the case, one strip of plastic ampules A0 drops.

Referring back to FIG. 1, under the ampule storage case 2 is a carrier unit 30 for receiving a strip of series-connected plastic ampules A0 and discharging them through an exit 3 provided at the bottom of the side plate of the stocker 1 with a plastic ampule A1 at one end of the strip at the first.

The carrier unit 30 is a belt conveyor comprising a pair of pulleys 31 and a belt 32 endlessly running around the pulleys 31. Its delivery end is at the exit 3.

At the exit 3, a guide plate 4 is provided over the conveyor, spaced from the conveyor surface by a distance enough for a strip of plastic ampules A0 to pass therethrough. The guide plate 4 prevents the floating of the strip of plastic ampules A0.

An ampule receiver 40 is provided at the delivery end of the carrier unit 30. While being fed by the carrier unit 30, the plastic ampule A1 at the head of each strip of series-connected plastic ampules abuts the ampule receiver 40 and stops.

Figure 6:
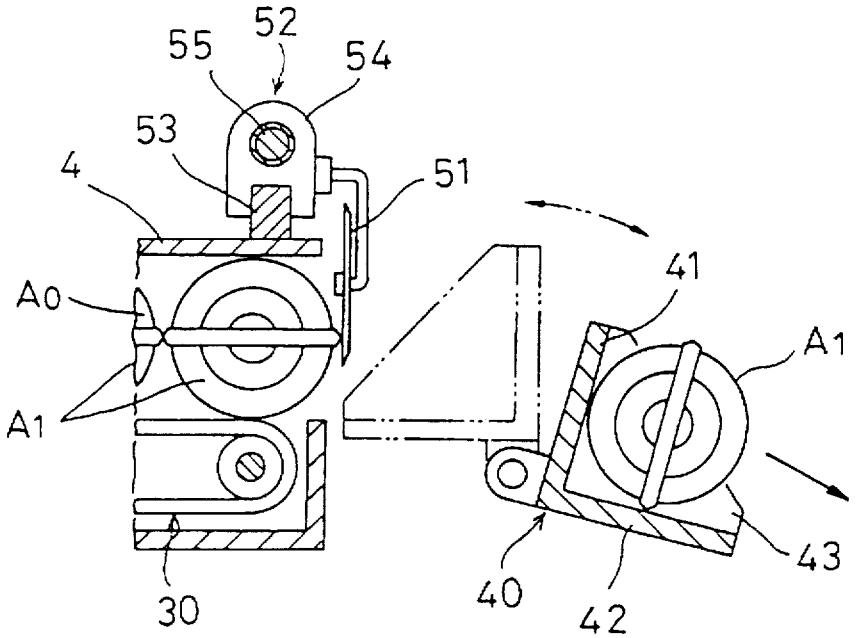
FIG. 6 is a sectional view taken along line VI—VI of FIG. 5.

The ampule receiver 40 includes a base plate 41 for supporting an ampule. A stopper plate 42 and a pair of end plates 43 are provided on the base plate 41 (FIG. 6). The ampule receiver 40 is turned 90° or more by a motor 44 between the position where the base plate 41 is horizontal and the position where it is vertical.

When the ampule A1 at the head of the strip moves onto the base plate 41, it is separated from the strip by a separating unit 50.

Figure 5:
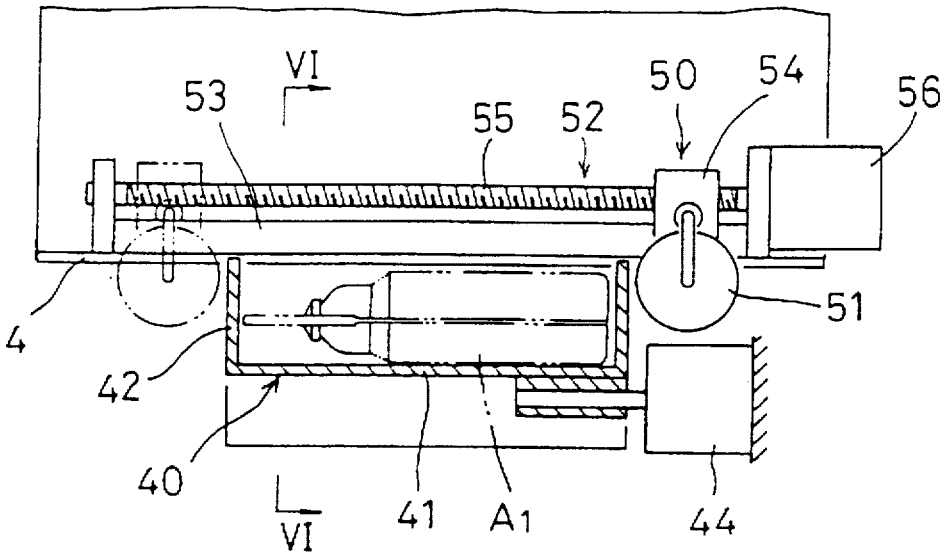
FIG. 5 is a sectional view taken along line V—V of FIG. 2.
Figure 10:
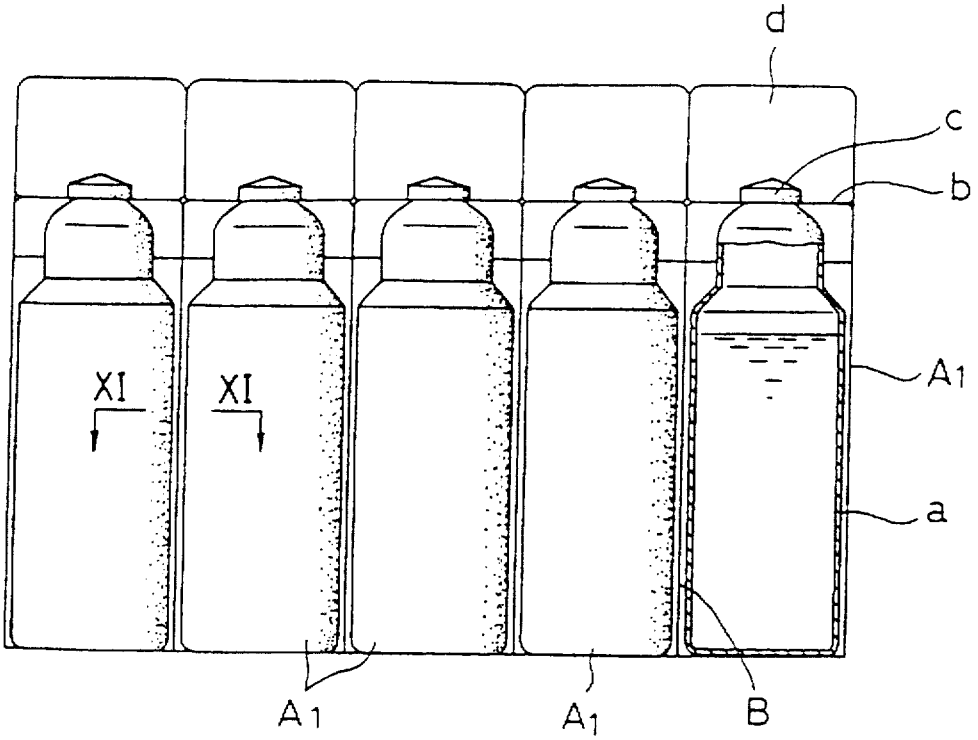
FIG. 10 is a partially cutaway front view of a strip of series-connected plastic ampules.
Figure 11:
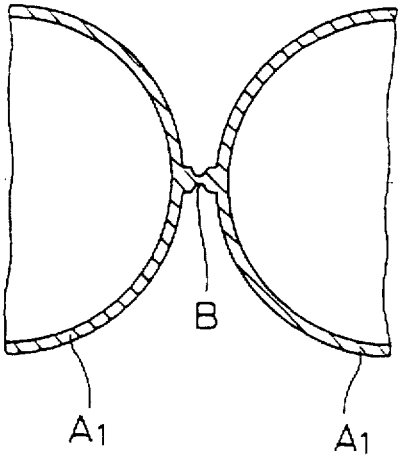
FIG. 11 is a sectional view taken along line XI—XI of FIG. 10.

Referring to FIGS. 5 and 6, the separating unit 50 comprises a disk-shaped cutter 51, and a cutter mover 52 for moving the cutter 51 along a line B (FIG. 10) between the front plastic ampule A1 received in the ampule receiver 40 and the plastic ampule A1 next to the front one.

The cutter mover 52 comprises a guide rail 53 extending in a direction perpendicular to the direction in which a strip of series-connected plastic ampules A0 are fed, a slide member 54 slidable along the guide rail 53 and rotatably supporting the cutter 51, and a threaded shaft 55 provided parallel to the guide rail 53. The slide member 54 is in threaded engagement with the threaded shaft 55. By rotating the threaded shaft 55 with a motor 56, the cutter 51 is moved parallel to the guide rail 53.

When the lowermost one of the stack of strips of plastic ampules A0 is dropped onto the carrier unit 30, it is fed forward by the carrier unit 30.

When the plastic ampule A1 at the head of the strip of ampules A0 is received in the ampule receiver 40, the carrier unit 30 stops. In this state, the cutter 51 is moved by the cutter mover 52 to cut the strip along the line B between the front ampule A1 and the next ampule A1.

When the frontmost ampule A1 is separated, the ampule receiver 40 is turned by the motor 44 until the base plate 41 stands upright to discharge the separated plastic ampule A1 from the ampule receiver 40.

After discharging the plastic ampule A1, the ampule receiver 40 returns to the original position to accept the next plastic ampule A1. In this state, the carrier unit 30 is actuated to feed the strip of plastic ampules A0 forward. The operation thus far described is repeated to separate and discharge plastic ampules one after another.

When all the plastic ampules forming the strip have been separated and discharged, the second stopper 12 shown in FIG. 3 is moved into the case to support the second lowest strip of ampules A0, and then the first stopper 11 is moved out of the case to drop the lowermost strip of ampules A0 onto the carrier unit 30.

In the embodiment of FIGS. 1–6 is shown the ampule receiver 40 comprising the base plate 41 carrying the stopper plate 42 and a pair of end plates 43. But the receiver type is not limited to that shown in the embodiment.

Figure 7:
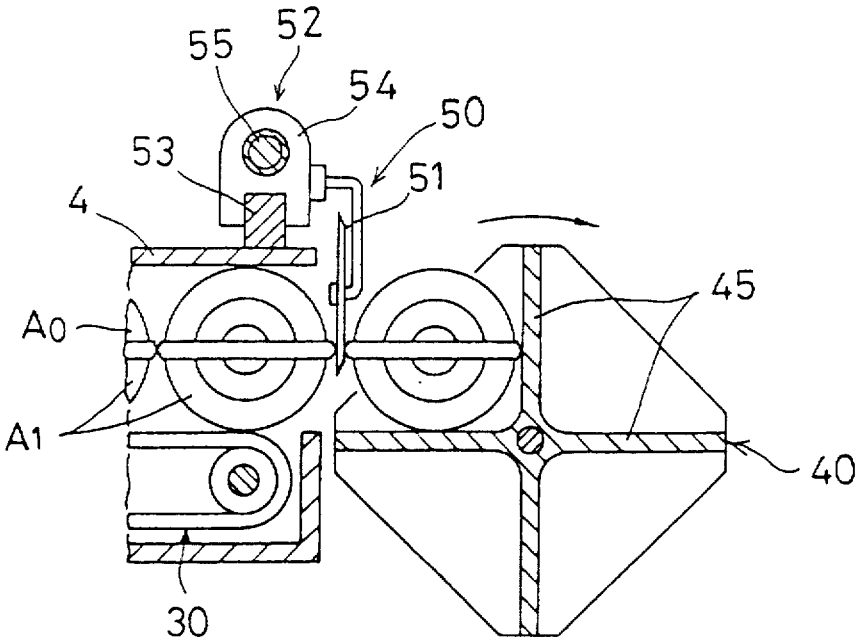
FIG. 7 is a sectional view of a different embodiment of stopper.

For example, an ampule stopper shown in FIG. 7 may be used. This ampule stopper comprises four plates 45 provided at 90° angular intervals around a center axis. It is rotated 90° in one direction every time a plastic ampule A1 is separated from the strip to discharge the separated ampule.

The ampule receiver 40 makes it possible to continuously operate the conveyor 30 and thus to separate ampules of a series-connected ampule strip with higher efficiency.

Figure 8:
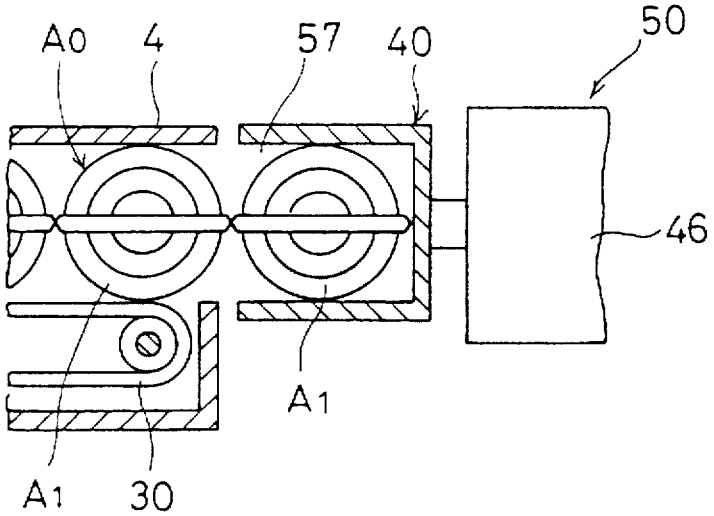
FIG. 8 is a sectional view of a different example of ampule separating unit.
Figure 9:
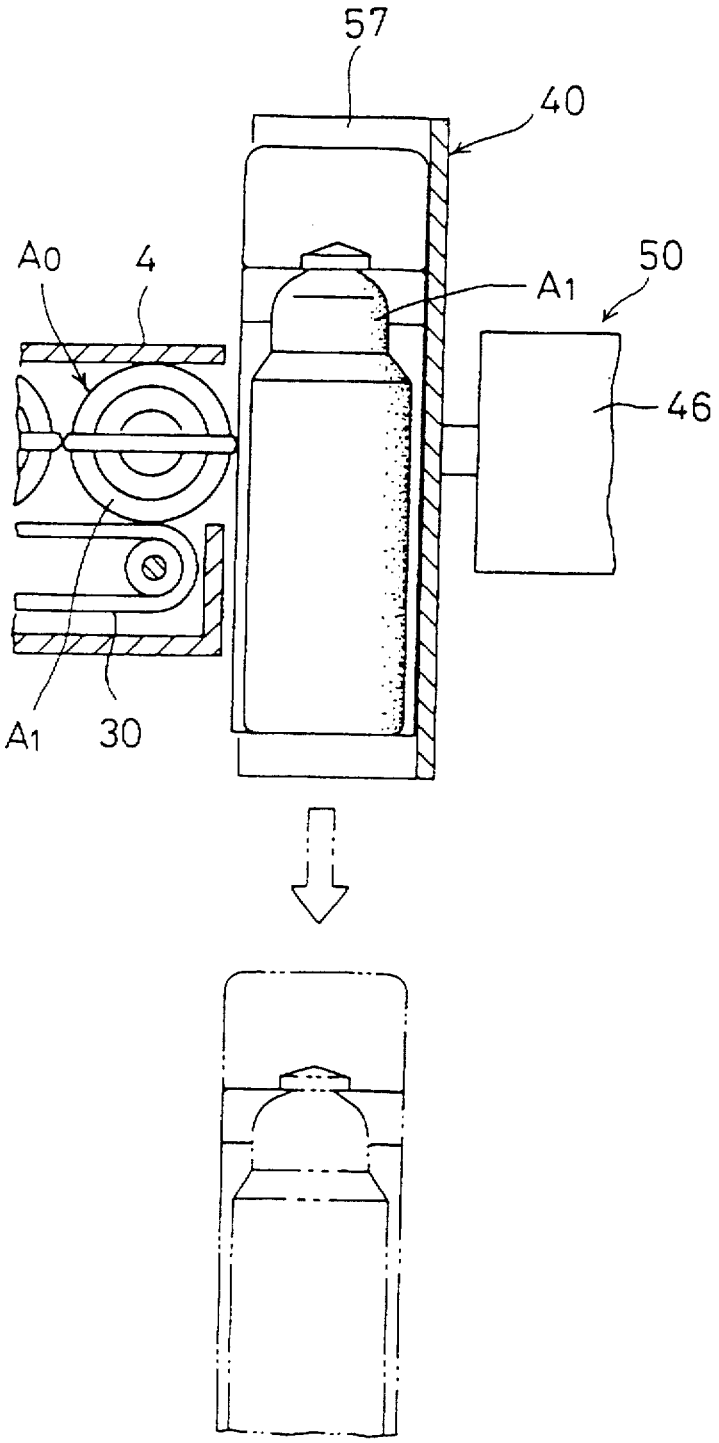
FIG. 9 is a sectional view of FIG. 8 in an operational state.

FIGS. 8 and 9 show another example of the ampule separating unit 50 for separating plastic ampules A1. This separating unit 50 comprises an ampule receiver 40 provided at the delivery end of the carrier unit 30 and formed with a recess 57 in which one ampule A1 can be received, and a motor 58 for turning the ampule receiver 40 around an axis extending parallel to the direction in which a strip of ampules A0 is fed by the carrier unit 30.

When the plastic ampule A1 at the head of a series-connected ampule strip A0 being fed by the carrier unit 30 is received in the recess 57 of the ampule receiver 40, the motor 58 is activated to rotate the ampule receiver 40. Since the ampule A1 next to the ampule at the head is held down by the guide plate 4, the strip is twisted and cut along the line B between the foremost and the next ampules A1. The foremost ampule A1 is thus separated.

The separated ampule A1 drops when the ampule receiver 40 rotates to nearly upright position as shown in FIG. 9. After dropping the ampule, the ampule receiver 40 rotates back to the horizontal position and waits for the next ampule.

According to the present invention, every time the plastic ampule at the leading end of the strip of series-connected plastic ampules is received in the receiver member, it is separated along the separating line between the ampule at the head of the strip and the next ampule by the ampule separating unit. Ampules can thus be separated one by one with high efficiency.

The ampule storage case is provided over the carrier means. The lowermost one of a plurality of strips of series-connected ampules stored in the ampule storage case is dropped onto the carrier means. Thus, it is possible to separate ampules continuously with high efficiency.

What is claimed is:

1. An ampule dispenser comprising a carrier means for transporting plastic ampules arranged side by side and series-connected together in a strip in a longitudinal direction, a guide plate provided over a delivery end of said carrier means for holding down the strip of series-connected plastic ampules, receiver means for receiving the plastic ampule at the head of the strip fed from the delivery end of said carrier means, and an ampule separating means for separating the ampule at the head of the strip along a separating line provided between adjacent ones of the ampules.

2. An ampule dispenser as claimed in claim 1 wherein said separating means comprises a cutter adapted to be moved along said separating line.

3. An ampule dispenser as claimed in claim 1 wherein said separating means comprises a recess formed in said receiver means and capable of receiving one plastic ampule, and rotating means for rotating said receiver means about an axis parallel to the direction in which the strip of series-connected ampules are fed.

4. An ampule dispenser as claimed in any of claims 1–3 further comprising an ampule storage means provided over said carrier means and capable of storing a plurality of strips of series-connected plastic ampules in a stack, and a discharge means for dropping the lowermost one of said strips of series-connected plastic ampules stored in said ampule storage means one by one onto said carrier means.

5. An ampule dispenser as claimed in claim 4 wherein said discharge means comprises a first stopper movable into and out of said ampule storage means for supporting the lowermost one of the strips of series-connected ampules stored in said ampule storage means, and a second stopper movable into and out of said ampule storage means for supporting the second lowest one of the strips of series-connected ampules stored in said ampule storage means, one of said first and second stoppers being moved out of said ampule storage means after the other of said first and second stoppers has been moved into said ampule storage means and stopped.

6. An ampule dispenser as claimed in claim 2, further comprising an ampule storage means provided over said carrier means and capable of storing a plurality of strips of series-connected plastic ampules in a stack, and a discharge means for dropping the lowermost one of said strips of series-connected plastic ampules stored in said ampule storage means one by one onto said carrier means.

7. An ampule dispenser as claimed in claim 3, further comprising an ampule storage means provided over said carrier means and capable of storing a plurality of strips of series-connected plastic ampules in a stack, and a discharge means for dropping the lowermost one of said strips of series-connected plastic ampules stored in said ampule storage means one by one onto said carrier means.

* * * * *